United States Patent [19]

Ohkubo et al.

[11] 3,933,508

[45] Jan. 20, 1976

[54] HEAT DEVELOPABLE LIGHT-SENSITIVE MATERIALS

[75] Inventors: Kinji Ohkubo; Takao Masuda, both of Minami-ashigara, Japan

[73] Assignee: Fuji Photo Film Co., Ltd., Minami-ashigara, Japan

[22] Filed: May 9, 1973

[21] Appl. No.: 358,559

[30] Foreign Application Priority Data

May 9, 1972 Japan ..... 47-45696

[52] U.S. Cl. ..... 96/114.1; 96/114.4; 96/114.6; 96/114

[51] Int. Cl.[2] ..... G03C 1/72; G03C 1/02

[58] Field of Search..... 96/114.1, 114.4, 114.6, 96/114, 50 PL

[56] References Cited

UNITED STATES PATENTS

| | | | |
|---|---|---|---|
| 3,468,664 | 9/1969 | Stewart | 96/95 |
| 3,615,490 | 10/1971 | Gaffin | 96/50 PL |
| 3,700,458 | 10/1972 | Lindholm | 96/114.1 |
| 3,756,829 | 9/1973 | Ohkubo et al. | 96/114.1 |

FOREIGN PATENTS OR APPLICATIONS

| | | | |
|---|---|---|---|
| 1,255,183 | 1/1971 | United Kingdom | 96/95 |

OTHER PUBLICATIONS

Chemical Abstracts, Vol. 66, 1967, page 8147.

*Primary Examiner*—David Klein
*Assistant Examiner*—Alfonso T. SuroPico
*Attorney, Agent, or Firm*—Sughrue, Rothwell, Mion, Zinn & Macpeak

[57] ABSTRACT

A heat developable light-sensitive material having increased transparency comprising, on a support, an organic silver salt, a light-sensitive silver halide, a reducing agent, a binder and an overcoat layer consisting essentially of a polymer.

19 Claims, No Drawings

HEAT DEVELOPABLE LIGHT-SENSITIVE MATERIALS

BACKGROUND OF THE INVENTION

1. Field of the Invention

This invention relates to a heat developable light-sensitive material and especially with a heat developable light-sensitive material having an overcoat layer of a polymer.

In accordance with the present invention, there is provided a heat developable light-sensitive material comprising, on a support member, (1) an organic silver salt, (2) a light-sensitive silver halide or a light-sensitive silver halide prepared by reacting an organic silver salt with a halide in situ, (3) a reducing agent, (4) a polymeric binder and (5) an overcoat layer comprising a polymer.

2. Description of the Prior Art

Photographic processes using a silver halide, giving a better sensitivity and gradient than the electrophotographic process and the diazotype photographic process, have been most commonly used. However, the silver halide light-sensitive material used for such processes is developed with a developing solution and then subjected to several processings such as stopping, fixing, water washing and stabilizing in order to protect the developed image from discoloring and fading under normal light as well as to protect the undeveloped areas (which will hereinafter be referred to as "background") from blackening. Therefore, such photographic processes take much time and labor and are subject to some problems, e.g., the chemicals used are injurious to humans and harmful to the work area, and often workers' hands and clothing are injured. In photographic processes using a silver halide, therefore, it has been desired that the processing be carried out in a dry state without solution processing, and the processed image be kept stable.

To reach this end, much effort has been expended to provide suitable methods. One method is the so-called mono bath development and fixing method wherein the two processings of development and fixing in an ordinary photographic process are finished in one processing, which is mentioned in U.S. Pat. No. 2,875,048, British Pat. No. 954,453 and German Pat. No. 1,163,142. A second method contemplates converting the wet processings in an ordinary silver halide photographic process into dry processings as disclosed in German Pat. No. 1,174,159, and British Pat. Nos. 943,476 and 951,644. A third method is to use a light-sensitive element consisting of a silver salt of a long chain aliphatic carboxylic acid such as behenic acid, the silver salt of saccharin or the silver salt of benzotriazole, and a catalytic amount of a silver halide, as disclosed in Japanese patent publication Nos. 4921/1968, 4924/1968, 26582/1969, 18416/1970, 12700/1970 and 22185/1970 and British Pat. No. 1,205,500.

SUMMARY OF THE INVENTION

The present invention belongs to the third of the above-mentioned three methods. The feature of the invention is that in a heat developable light-sensitive material having a light-sensitive layer of a heat-developable light-sensitive composition comprising an organic silver salt stable to light, for example, a silver salt of a fatty acid such as silver behenate, the silver salt of benzotriazole or the silver salt of saccharin, a light-sensitive silver halide in a catalytic amount, a reducing agent and a polymeric binder, a polymer overcoat layer is provided on the light-sensitive layer. Mixtures of components within the groups can, of course, be used.

The following points are improved by the provision of such an overcoat polymer layer.

1. The transparency of the coating layer is raised and a heat developable light-sensitive (film) material can be obtained.

That is to say, a heat developable light-sensitive material is ordinarily subjected to imagewise exposure and development only by heating, and the subsequent operations are omitted. The usual operations in the silver halide photographic materials, which comprise, after development, treating the undeveloped silver halide with a fixing solution containing a compound capable of forming a silver halide complex, for example, sodium thiosulfate, to convert the silver halide into a water-soluble silver complex and then washing with water to remove the silver complex salt, are not carried out in the case of such a heat developable light-sensitive material. In other words, the silver salt used in a heat developable light-sensitive material is not removed after development, unlike the silver halide in a silver halide photographic material. Therefore, if a silver salt with a coarse grain or large grain size is used as the silver salt for a heat developable light-sensitive material (exclusive of the case of applying this to an opaque sheet of paper), a light-sensitive material having a transparent coating layer cannot be obtained by applying the same to a transparent film support. As mentioned hereinbefore, in a silver halide photographic material which is subjected to the fixing operation after development, when the coating layer is not transparent before development it becomes transparent after the silver halide is removed by fixing and washing with water following development, even though a coarse grain silver halide is used.

Where it is desired to obtain a light-sensitive material having a transparent coating layer using a silver salt in a heat developable light-sensitive material, a coating layer which is transparent before development is obtained by the use of a silver salt which has a grain size which is as fine as possible. Since the techniques for producing a fine grain silver salt are restricted even at this date, a rather opaque coating layer, which is not suitable as a transparent heat-developable light-sensitive material, is obtained by providing a transparent film support with an ordinary light-sensitive layer. In accordance with the invention, however, the transparency of a coating layer is remarkably raised by providing on such an ordinary light-sensitive layer an overcoat layer of a polymer, and an extremely transparent coating layer is obtained through the use of a silver salt with a fine grain size.

2. The raw storage property is improved.

As mentioned above, a heat developable light-sensitive material has a light-sensitive layer consisting mainly of an organic silver salt, a catalytic amount of light-sensitive silver halide, a reducing agent and a binder on a support member. Of these constituents, in particular, the reducing agent is subject to the influence of oxygen in the air and greatly affected when stored at a high temperature and high humidity. The reducing agent is oxidized and loses its reducing activity to reduce an organic silver salt by the catalytic action of sensitized silver halide during heating. When the reducing agent is affected by oxygen, therefore, a satisfactory silver image is difficult to obtain. On the contrary, the provision of an overcoat layer on the light-sensitive layer according to the invention prevents the reducing agent from undergoing air oxidation and thus markedly improves the raw storage property.

3. As occasion demands, adhesion of the coating layer to a developing machine during developing is prevented.

When a heat developable light-sensitive material using polyvinyl butyral as a binder in the light-sensitive layer is developed by heating, for example, between metal plates at 130°C for 20 seconds, the polyvinyl butyral softens and the coating layer adheres to the metal plates. In accordance with the invention, on the contrary, heat development can be carried out without adhesion of the coating layer to metal plates and without scratching the film surface, if in the case of providing on the light-sensitive layer a heat resistant polymer having a higher softening point is used as the overcoat polymer.

4. The image density is raised.

The image density is increased by providing an overcoat polymer layer as compared to elements with identical coated silver amounts but no overcoat polymer layer (see Examples 10 and 11). It is not clear why the image density is raised. It is assumed, however, that the heat development is carried out with high efficiency because the heat developable light-sensitive layer is enclosed between the support and the overcoat polymer layer.

The foregoing advantages (2), (3) and (4) are similarly attained when the invention is carried out on a heat-developable light-sensitive layer provided on a semi-transparent or opaque support such as paper, synthetic paper, water resistant paper, such as resin-coated paper, and metal. All such cases are, of course, within the present invention.

The invention has the foregoing features, which are essential for obtaining a transparent, heat developable light-sensitive material.

It is thus one object of the invention to provide a transparent heat developable light-sensitive material.

It is another object of the invention to provide a heat developable light-sensitive material having a high image density and excellent raw storage property.

It is a further object of the invention to provide a heat developable light-sensitive material having a coating layer excellent in heat resistance.

In accordance with the invention, there is provided a heat developable light-sensitive material comprising, on a support member, (1) an organic silver salt, (2) a light-sensitive silver halide or a light-sensitive silver halide prepared by reacting an organic silver salt with a halide, (3) a reducing agent, (4) a polymeric binder and (5) an overcoat layer comprising a polymer.

DETAILED DESCRIPTION OF THE INVENTION

A simple test can be used to determine how the features or effects of the invention are brought about by providing an overcoat layer on a heat developable light-sensitive material. The test method is as follows:

1. Effect of improving transparency of a coating layer

The following constituents are dispersed in a ball mill at about 25°C for 1 hour.

| | |
|---|---|
| polyvinyl butyral | 3.0 g |
| silver laurate | 2.7 g |
| isopropyl alcohol | 20 ml |

The resultant dispersion is coated onto a transparent support of polyethylene terephthalate film to give 2 g of coated silver per 1 $m^2$ of support.

Onto such a layer containing a silver salt is overcoated a 15 wt % solution of the polymers mentioned hereinafter to give various samples each having a polymer overcoat film of a thickness of 2 microns. The sample is then exposed and heated at 120° – 140°C for 1–60 seconds. The change of the transmission of the coating layer to a light source of a wavelength of 500 millimicrons is measured by means of a spectrophotometer. In certain cases, mere visual examination is sufficient to show a gross difference in effect. The heat resistance, of course, is easily determined by examining the tackiness of the layer, and the raw storage property can be determine by measuring the degree of deterioration by a forced deterioration at 50°C, 80% RH or by storage at normal conditions for a long period of time.

It will be apparent from the following Examples that the transmission or transparency of the coating layer is raised by providing an overcoat layer and, similarly, the image density, raw storage property and heat resistance are improved by the overcoat layer. The silver laurate used in the test is ordinarily prepared by the following procedures:

To a solution of 11 g of lauric acid in 100 ml of butyl acetate kept at 10°C is added 100 ml of a dilute aqueous solution of nitric acid (25°C, pH = 2.0) while stirring, and 50 ml of an aqueous solution of a silver ammonium complex (silver ammine complex) containing 8.5 g of silver nitrate (cooled to 0°C) is added over a 1 minute period to react the laurate and the silver ions, thus obtaining crystals of silver laurate in a spindle shape of about 1 micron (long side) by about 0.05 micron (short side). The thus obtained silver salt is washed with water and methanol and, as mentioned above, dispersed in a solution of polyvinyl butyral.

Examples of polymers used for the overcoat layer according to the invention, which are preferably heat-resistant, colorless and soluble in solvents, are polyvinyl chloride, polyvinyl acetate, copolymers of vinyl chloride and vinyl acetate containing more than 50 mol percent vinyl chloride but insufficient vinyl chloride to lower the heat resistance, polyvinyl butyral, polystyrene, polymethyl methacrylate, benzyl cellulose, ethyl cellulose, cellulose acetate butyrate, cellulose acetate, polyvinylidene chloride, polyvinyl pyrrolidone, cellulose propionate, polyvinyl formal, cellulose acetate phthalate, polycarbonates and cellulose acetate propionate. Moreover, gelatin, gelatin derivatives such as phthalated gelatin, acrylamide polymers, polyisobutylene, butadiene-styrene copolymers (no limitation on monomer proportions) and polyvinyl alcohol are preferred.

The above listing, of course, is merely representative of the many polymers which can be used in the overcoat layer according to this invention.

Most preferred polymers which can be used in the overcoat layer of present invention are those which are heat resistant, that is, which are not deformed, at temperatures greater than about 115°F, and which have a refractive index greater than 1.45 at 20°C.

The viscosity, molecular weight, degree of polymerization, etc., of such materials are factors which relate primarily to the coating ability of the polymers, and these factors are not important in the present invention. Phrased somewhat differently, these factors can be easily balanced by one skilled in the art since they relate to mechanical rather than photographic aspects of the present invention.

The thickness of the overcoat polymer layer according to the invention is preferably about 1 to about 20 microns. If it is too thin, the effects decrease, while if it is too thick the production cost rises without a significant increase in benefits.

The organic silver salts used in the present invention are not particularly limited so long as, of course, they function in the heat developable light-sensitive material of the present invention to provide an image of sufficient density. Most preferred are, however, silver salt of organic carboxylic acids and silver salts of heterocyclic compounds containing an imino group. The most preferred silver salts or organic carboxylic acids are these of long-chain aliphatic carboxylic acid.

Specific examples of such organic silver salts used in the invention are silver salts of fatty acids, preferably long chain alphatic fatty acid having more than 10 carbon atoms, such as silver laurate, silver myristate, silver palmitate, silver stearate and silver behenate, silver caprate, and the silver salt of benzotriazole, the silver salt of saccharin, the silver salt of phthalazinone, silver phthalate, silver terephthalate and silver salicylate. These silver salts are relatively stable to light and in an exposed area are reduced by a reducing agent upon heating by the catalytic action of a silver halide to give a silver image. Preferred of such materials as are used in the present invention have a size which can be analogized to a sausage link, where the long side is the measurement taken along the axis of the link, and the short side is the diameter transverse of the long side, where the long side is 0.01 – 5 microns, preferably 0.1 – 1 micron, and the short side is 0.0001 – 0.5 microns, preferably 0.005 – 0.1 micron.

The amount of the organic silver salt used is that necessary to provide an image of sufficient density. Generally speaking, since the visual acuity of users will vary greatly, from about 0.2 to about 3 g/m$^2$, calculated as silver, is applied to the support. Preferably, to provide a safety factor, 0.4 g/m$^2$ of support or greater is used, and generally speaking seldom will be greater than 2 g/m$^2$ of support be used, all figures being on the same basis. The upper limit of 3 g/m$^2$ of support is set because greater amounts tend to increase cost without any substantial benefit in image density.

As the reducing agent of the invention, any compound capable of reducing the organic silver salt to give a silver image when heated in the presence of exposed silver halide can be used, for example, substituted phenols, substituted or unsubstituted bisphenols, substituted or unsubstituted bisnaphthols, naphthols, substituted naphthols, di- or higher poly- hydroxybenzenes such as hydroquinone derivatives, ascorbic acid and its derivatives, di-or higher poly-naphthalenes and 3-pyrazolidones. For instance, including hydroquinone mono ethers, ascorbic acid or mono-or di-carboxylic acid esters of ascorbic acid, reducing sugar, 5-hydroxy-2-hydroxymethyl-γ-pyrone, 4-isopropyltropolones, substituted or unsubstituted 1-aryl-3-pyrazolidones, which can be alkyl ($C_{1-8}$), alkoxy ($C_{1-8}$), phenyl, halogen, amino, alkyl substituted amino ($C_{1-8}$) acetyl, nitro, etc., substituted.

Specific examples of such materials are;

hydroquinone, methylhydroquinone, chlorohydroquinone, bromohydroquinone, phenylhydroquinone, hydroquinone mono sulfonate, t-octylhydroquinone, t-butylhydroquinone, 2,5-dimethylhydroquinone, 2,6-dimethylhydroquinone, methoxyhydroquinone, ethoxyhydroquinone, p-methoxyphenol, p-ethoxyphenol, hydroquinone monobenzylether, catechol, pyrogallol, resorcin, p-aminophenol, o-aminophenol, N-methyl-p-aminophenol, 2-methoxy-4-aminophenol, 2,4-di-aminophenol, 2-β-hydroxyethyl-4-aminophenol, p-t-amylphenol, p-t-aminophenol, p-cresol, 2,6-di-t-butyl-p-cresol, p-acetophenol, p-phenylphenol, o-phenylphenol, 1,4-dimethoxyphenol, 3,4-xylenol, 2,4-xylenol, 2,6-dimethoxyphenol, 1-amino-2-naphthol-6-sulphonic acid sodium salt, 1-naphthylamine-7-sulphonic acid, 1-hydroxy-4-methoxynaphthalene, 1-hydroxy-4-ethoxy-naphthalene, 1,4-dihydroxynaphthalene, 1,3-dihydroxynaphthalene, 1-hydroxy-4-aminonaphthalene, 1,5-dihydroxynaphthalene, 1-hydroxy-2-phenyl-4-methoxynaphthalene, 1-hydroxy-2-phenyl-4-methoxynaphthalene, 1-hydroxy-2-methyl-4-methoxynaphthalene, α-naphthol, β-naphthol, 1,1'-dihydroxy-2,2'-binaphthyl, 4,4'-dimethoxy-1,1'-dihydroxy-2,2'-binaphthyl, 6,6'-dibromo-2,2'-dihydroxy-1,1'-binaphthyl, 6,6'-dinitro-2,2'-dihydroxy-1,1'-binaphthyl, bis(2-hydroxy-1-naphthyl)methane, bisphenol A, 1,1-bis-(2-hydroxy-3,5-dimethylphenyl)-3,5,5-trimethylhexane, 2,4,4-trimethylpentyl-bis(2-hydroxy-3,5-dimethylphenyl)-3,5,5-trimethylhexane, 2,4,4-trimethylpentyl-bis-(2-hydroxy-3,5-dimethylphenyl)methane, bis-(2-hydroxy-3-t-butyl-5-methylphenyl)methane, bis-(2-hydroxy-3,5-di-t-butylphenyl)methane, 4,4'-methylenebis-(3-methyl-5-t-butylphenol), 4,4'-methylenebis-(2,6-di-t-butylphenol), 2,2'-methylenebis-(2-t-butyl-4-ethylphenol), 2,6-methylenebis-(2-hydroxy-3-t-butyl-5-methylphenyl)-4-methylphenol, 3,3',5,5'-tetra-t-butyl-4,4'-dihydroxybiphenyl, 1-ascorbic acid, 1-ascorbic acid monoester, 1-ascorbic acid diester, p-oxyphenylglycine, N,N-diethyl-p-phenylene diamine, furoin, benzoin, dihydroxyacetone, glycerine aldehyde, rhodizonic acid-tetrahydroxyquinone, methyl gallate, propyl gallate, hydroxytetoronic acid, N,N-di-(2-ethoxyethyl)hydroxylamine, glucose, lactose, 1-phenyl-3-pyrazolidone, 4-methyl-4-hydroxymethyl-1-phenyl-3-pyrazolidone, bis-(3-methyl-4-hydroxy-5-t-butylphenyl)-sulfide, 3,5-di-t-butyl-4-hydroxybenzyldimethylamine, α,α'-(3,5-di-t-butyl-4-hydroxyphenyl)-dimethylether and the like.

A relatively strong reducing agent such as a bisphenol is suitable for a silver salt of a higher fatty acid such as silver behenate, while a relatively weak reducing agent such as a substituted phenol is suitable for a silver salt of a lower fatty acid such as silver laurate. When a weak reducing agent such as p-(t-butyl)-phenol is used for silver behenate, for example, only a low density image is obtained, and when a strong reducing agent such as hydroquinone is used for silver laurate, for example, the fog increases with a lowering of the contrast of the image.

The quantity of the reducing agent according to the invention, which will depend on the organic silver salt and reducing agent combination, is preferably about 0.1 to about 5 mols per 1 mol of the organic silver salt, preferably 0.5 mol to 1 mol per mol of the organic silver salt.

As the light-sensitive silver halide used in the invention in a catalytic amount, silver chloride, silver bromide, silver bromoiodide, silver chlorobromoiodide, silver chlorobromide, silver iodide and mixtures thereof are preferred. These silver halides may be either coarse grains or fine grains, and a very fine grain emulsion is particularly preferred. An emulsion containing such a light-sensitive silver halide(s) can be prepared by any conventional manner in the photographic field. For example, there are single jet emulsions, double jet emulsions, Lippmann emulsions, ammonia process emulsions, thiocyanate or thioether aged emulsions and emulsions as disclosed in U.S. Pat. Nos. 2,222,264; 3,320,069 and 3,271,157, all of which can be used in the present invention.

The silver halide used in the practice of the invention may be sensitized by a chemical sensitizer or reducing agent, such as, for example, sulfur or selenium compounds, gold, platinum or palladium compounds or combinations thereof. Suitable sensitizations methods are described, for example, in U.S. Pat. Nos. 2,623,499; 2,399,083; 3,297,447 and 3,297,446.

As mentioned above, the light-sensitive silver halide in a catalytic amount can be previously prepared and added as one constituent of the light-sensitive layer of the invention, but it is preferred to form the silver halide in situ as a part of the organic silver salt by reacting the organic silver salt as a constituent of the light-sensitive layer of the invention with a halide as a component capable of forming the light-sensitive silver halide in a catalytic amount. For example, a halide such as ammonium bromide is added to a polymeric dispersion of silver laurate prepared as mentioned hereinbefore, whereby a part of the silver laurate and ammonium bromide are reacted to form silver bromide, which is confirmed by a change in the X-ray diffraction pattern of the system.

As halides suitable for the invention there are inorganic halogen compounds, for example, represented by MXn in which M represents a hydrogen atom, ammonium group or metal atom, X represents a halogen atom and *n* represents the atomic valence of M. Illustrative of the halides of the invention are chlorides, bromides and iodides of hydrogen, ammonium, strontium, cadmium, zinc, tin, chromium, sodium, barium, iron, cesium, lanthanum, copper, calcium, nickel, magnesium, potassium, aluminum, antimony, gold, cobalt, mercury, lead, beryllium, lithium, manganese, gallium, indium, rhodium, ruthenium, palladium, iridium, platinum, thallium, bismuth and mixtures thereof. Furthermore, organic halides such as triphenylmethyl chloride, triphenylmethyl bromide, 2-bromo-2-methylpropane, 2-bromobutyric acid, 2-bromoethanol and benzophenone dichloride, and halogenated hydrocarbons such as iodoform, bromoform and carbon tetrabromide can also be used with success.

The quantity of the light-sensitive silver halide or halide as a constituent for forming the same is preferably about 0.001 to about 0.5 mol per 1 mol of the organic silver salt, more preferably 0.01 mol to 0.1 mol of the silver halide per mol of the organic silver salt. The reaction of the halide to form silver halide is substantially stoichiometric. If less than about 0.001 mol is used, the sensitivity lowers, while if more than about 0.5 mol is used, the quantity of silver halide becomes too high, which results in (due to the silver halide gradually blackening under the influence of room light) a blackening of the non-image area of a heat-developed material when it is allowed to stand under room light and, consequently, a decrease of contrast with image areas.

The reaction of the inorganic or organic halide with the organic silver salt proceeds easily and substantially stoichiometrically, and in practice the inorganic or organic halide is merely mixed with a polymer dispersion of the organic silver salt at room temperature for a few minutes. Generally speaking, operation at 0° to about 80°C, more preferably at 20° to 60°C, is used in a system open to the atmosphere. Little is to be gained by sub- or super-atmospheric operation. Mixing is merely for a time sufficient for the reaction to be completed, and generally will be 1 second or greater and seldom more than 60 minutes, with common reaction times being 30 seconds to 30 minutes.

In the heat developable light-sensitive composition used in the invention there may be incorporated any binder which is ordinarily hydrophobic, but hydrophilic binders can also be used. The binders are transparent or semitransparent, for example, natural materials such as gelatin, gelatin derivatives and cellulose derivatives, and synthetic polymeric substances such as polyvinyl compounds and acrylamide polymers. Other synthetic polymer compounds used are dispersed vinyl compounds of the latex type.

Moreover, desirable high molecular weight materials and resins include polyvinyl butyral, cellulose acetate butyrate, polymethyl methacrylate, polyvinyl pyrrolidone, ethyl cellulose, polystyrene, polyvinyl chloride, cellulose propionate, cellulose nitrate, phthalated gelatin, polyvinyl acetate, polyvinylidene chloride, polyvinyl formal, chlorinated rubber, polyisobutylene, butadiene-styrene copolymers, vinyl chloridevinyl acetate copolymer, vinyl acetate-vinyl chloride-maleic acid copolymers and polyvinyl alcohol. The ratio of the binder to organic silver salt is preferably, based on the weight of the organic silver salt, about 4 to 1 to about 1 to 4 parts.

Any material can be used as the support member of the heat developable light-sensitive material of the invention, typical of which are cellulose nitrate films, cellulose ester films, poly(vinyl acetal) filsm, polystyrene films, polyethylene terephthalate films, polycarbonate films, resinous materials, glass, paper and metals.

In short, the only limitation on the support member is that it not be excessively degraded during the exposure or heat development steps nor, of course, be composed of a material which would adversely affect the light-sensitive elements. Such characteristics will be obvious to one skilled in the art, however, and one skilled in the art can easily decide on the best support for any practial use.

The thickness of the light-sensitive layer can vary greatly in the present invention, but generally speaking, thicknesses of from about 1 micron to about 15 microns, more preferably 3 microns to 10 microns, are used in combination with a overcoat layer having a thickness of from about 1 micron to about 20 microns, more preferably 2 microns to 10 microns.

The heat developable light-sensitive material used for the practice of the invention can be provided with an anti-static layer or an electrically conductive layer.

Moreover, an anti-halation substance or antihalation dye can be incorporated in the light-sensitive layer.

As occasion demands, in the heat developable light-sensitive material according to the invention there may further be incorporated a matting agent such as starch, titanium dioxide, zinc oxide or silica, and a brightening agent of the stilbene type, triazine type, oxazole type or coumarin type.

The heat developable light-sensitive layer of the invention can be coated by various coating methods, for example, an immersion method, an air-knife method, a curtain coating method and an extrusion coating method using a hopper as described in U.S. Pat. No. 2,681,294. If desired, two or more layers can simultaneously be coated.

Furthermore, optical sensitizing dyes may favorably be used in the elements of the invention so as to impart light-sensitivity thereto. Optical sensitization is ordinarily carried out, for example, by adding a sensitizing dye in the form of a solution or dispersion in an organic solvent. As such optical sensitizers, cyanine and merocyanine dyes are usually used.

A latent image formed by exposing the above-mentioned elements of the heat developable light-sensitive material to a light source such as a xenon lamp, tungsten lamp or mercury lamp can be developed merely by heating the elements. In another embodiment of the invention, therefore, a latent image in the elements of the exposed heat developable light-sensitive material is developed by heating at about 100° to about 160°C until the desired image is developed. The developing temperature is preferably 110° to 140°C. Within the broad temperature range, a higher temperature or lower temperature may optionally be used by lengthening or shortening the heating time. A developed and stabilized image is ordinarily obtained in 1 to 60 seconds. The heating of the above-mentioned elements can be carried out by any suitable method such as by contacting the elements with a simple heating plate, contacting them with a heating drum, passing them through a heating space or subjecting them to high frequency heating.

The following examples are to illustrate the invention in more detail without limiting the same.

In all examples where a light-sensitive composition is formed by the in situ reaction of a halide with the organic carboxylic acid silver salt, mixing was conducted at 40°C, and at atmospheric presssure merely by stirring for about 5 minutes.

EXAMPLE 1

To a solution of 11 g of lauric acid in 100 ml of butyl acetate kept at 10°C was added 100 ml of a dilute aqueous solution of nitric acid (25°C, pH = 2.0) with stirring, and 50 ml of an aqueous solution of silver ammonium complex [this salt can be represent by the formula $[Ag(NH_3)_2]^+NO_3^-$; from 1 molar $AgNO_3$ and 2 molar $NH_3$ (used as $NH_4OH$)] containing 8.5 g of silver nitrate (cooled at 0°C) was then added over a 1 minute period to react the laurate and silver ions, thus obtaining crystals of silver laurate in a spindle shape of about 1 micron (long side) by about 0.05 micron (short side). The thus obtained silver salt was washed with water and methanol and 2.7 g of it was ball-milled with 3.0 g of polyvinyl butyral (average degree of polymerization 1,000; index of refraction 1.47–1.49; heat resistant to about 115°F) and 20 ml of isopropyl alcohol to prepare a polymer dispersion of the silver salt. An effective amount of 1, 3 dibromo-5,5-dimethylhydantoin (2.5 weight percent methyl cellosolve solution) was added thereto (1 ml) as an anti-heat fogging agent, 1 ml of a 2.5 weight percent methanol solution of ammonium bromide was added (silver halide forming agent) and 5 ml of a 0.0025 weight percent chloroform solution of the following light-sensitive dye was added thereto:

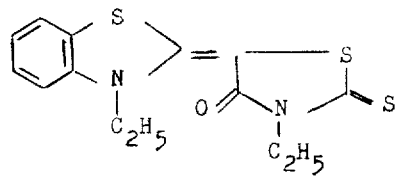

3 ml of a 70 weight percent methyl cellosolve solution of p-phenylphenol was added as a reducing agent, and 1 ml of a 2.5 weight percent methyl cellosolve solution of phthalazinone was added thereto as a toning agent.

The resulting dispersion was coated onto a transparent polyethylene terephthalate film support member to give 2.0 g of coated silver per 1 $m^2$ of the support. In the following Examples, this coated sample will be referred to as a "silver laurate coated sample".

Onto the silver salt layer of the silver laurate coated sample was overcoated a 15 wt % methyl ethyl ketone solution of polystyrene (index of refraction 1.59–1.60; heat resistant to 150° – 170°F) to give a film thickness of 2 microns (dry basis).

The change of transmittivity of the coating layer to a light source of a wavelength of 500 millimicrons was measured by means of a spectrophotometer, thus obtaining the following results. The transmittivity of the film support was taken as 100% as a standard. The measurements in the following Examples were all carried out according to this standard.

| | Transmittivity (%) |
|---|---|
| overcoat free | 35.0 |
| polystyrene overcoated | 55.5 |

It is evident from these results that the transmittivity, that is, the transparency of the coating layer, is markedly increased by providing a polystyrene overcoated layer.

When the sample having the polystyrene overcoat layer was held between heated metal plates and heated at 120°C for 20 seconds, adhesion of the film surface to the metal plates was scarcely encountered.

EXAMPLE 2

Onto the silver salt layer of the silver laurate coated sample prepared in Example 1 was overcoated a 15 wt % methyl ethyl ketone solution of cellulose acetate butyrate (index of refraction 1.46 – 1.49; heat resistant to 140° – 220°F) to give a film thickness of 2 microns (dry basis).

The change of transmittivity of the coating layer was measured as in Example 1 to obtain the following results:

| | Transmittivity (%) |
|---|---|
| overcoat free | 35.0 |
| cellulose acetate butyrate overcoat | 52.7 |

The transparency of the coating layer was markedly increased by providing the cellulose acetate butyrate overcoat layer.

When the sample having the cellulose acetate butyrate overcoat layer was held between metal plates and heated at 120°C for 20 seconds, adhesion of the film surface to the metal plates was scarcely encountered.

EXAMPLE 3

Onto the silver salt layer of the silver laurate coated sample prepared in Example 1 was overcoated a 15 wt % tetrahydrofuran solution of polyvinyl chloride (index of refraction 1.54 – 1.56; heat resistant to 150°F) to give a film thickness of 2 microns (dry basis).

The change of transmittivity of the coating layer was measured as in Example 1 to obtain the following results:

| | Transmittivity (%) |
|---|---|
| overcoat free | 35.0 |
| polyvinyl chloride overcoat | 49.9 |

The transparency of the coating layer was markedly increased by providing the polyvinyl chloride overcoat layer.

When the sample having the polyvinyl chloride overcoat layer was held between metal plates and heated at 120°C for 20 seconds, adhesion of the film surface to the metal plates was scarcely encountered.

EXAMPLE 4

Onto the silver salt layer of the silver laurate coated sample prepared in Example 1 was overcoated a 15 wt % methyl ethyl ketone solution of cellulose acetate (index of refraction 1.46 – 1.50; heat resistant to 140° – 220°F) to give a film thickness of 2 microns (dry basis).

The change of transmittance of the coating layer was measured as in Example 1 to obtain the following results:

| | Transmittance (%) |
|---|---|
| overcoat free | 35.0 |
| cellulose acetate overcoat | 47.4 |

The transparency of the coating layer was markedly increased by providing the cellulose acetate overcoat layer.

When the sample having the cellulose acetate overcoat layer was held between heated metal plates and heated at 120°C for 20 seconds, adhesion of the film surface to the metal plates was scarcely encountered.

EXAMPLES 5 to 9

Onto the silver salt layer of the silver laurate coated sample prepared in Example 1 was overcoated each of the following polymer solutions to give a film thickness of 2 microns (dry basis).

The change of transmittivity of the coating layer was measured in the similar manner to Example 1 to obtain the following results:

| | Transmittivity (%) |
|---|---|
| overcoat free | 35.0 |
| (5) Vinyl chloride-vinyl acetate copolymer (vinyl chloride 95 wt %, vinyl acetate 5 wt %)* 15 wt % tetrahydrofuran solution | 48.5 |
| (6) polymethyl methacrylate** 15 wt % tetrahydrofuran solution | 51.4 |
| (7) xylene resin 15 wt % tetrahydrofuran solution | 65.1 |
| (8) benzyl cellulose 15 wt % tetrahydrofuran solution | 55.5 |
| (9) polyvinyl butyral 15 wt % isopropyl alcohol solution | 42.7 |

*Same as in Example 12.
**Same as in Example 13.

It is apparent that the transparency is markedly increased by overcoating any of the above mentioned polymers.

Similar effects or merits as in the foregoing Examples were also obtained with other silver salts of fatty acids such as silver myristate, silver palmitate, silver stearate and silver behenate, and other silver salts mentioned in this specification such as silver salt of benzotriazole, some of which will be disclosed in the following.

EXAMPLE 10

3.4 g of behenic acid was dissolved in 100 ml of toluene at 60°C and kept at 60°C. With stirring, a solution of 0.1 g of mercuric nitrate in 100 ml of a dilute aqueous nitric acid (pH = 2.0, 25°C) was added thereto. To the resulting mixed solution there was added with agitation at 60°C 100 ml of an aqueous solution (pH of 11.8 ) prepared by adding ammonia water to about 80 ml of an aqueous solution containing 1.7 g of silver nitrate to prepare a silver ammonium nitrate complex salt and diluting with water to 100 ml, thus obtaining a dispersion containing silver behenate fine crystals. When the dispersion was allowed to stand at room temperature for 20 minutes, an aqueous phase and toluene phase separated. The aqueous phase was removed and 400 ml of fresh water was added to the toluene phase, followed by decantation. This operation was repeated three times and then 400 ml of methanol was added, followed by centrifugal separation, to obtain 4.1 g of silver behenate grains in a substantially spherical shape of about 0.3 micron in diameter. 2.5 g of this silver behenate was added to 20 ml of a solution of 2 g of polyvinyl butyral (average degree of polymerization of 1,000) in isopropyl alcohol and ball milled for 1 hour to prepare a polymer dispersion of the silver salt. To 20 ml of the thus obtained polymer dispersion of silver salt were added the following constituents to prepare a heat developable light-sensitive composition which was coated onto several transparent polyethylene terephthalate film supports at a silver amount of 1.5 g per 1 $m^2$ of support, thus obtaining heat developable light-sensitive materials.

| | |
|---|---|
| ammonium bromide (2.5 wt 9. methanol solution) | 1 ml |
| benzoxazolidenerhodanine sensitizing dye (0.025 wt % chloroform solution) | 1 ml |
| 2,2'-methylene-bis(6-t-butyl-4-methylphenol) (25 wt % methyl cellosolve solution) | 3 ml |
| phthalazinone (2.5 wt % methyl cellosolve solution) | 1 ml |

One light-sensitive material thus obtained (Sample A) was not overcoated and one light-sensitive material thus obtained (Sample B) was overcoated with a 15 wt % tetrahydrofuran solution of vinyl chloride-vinyl acetate copolymer (vinyl chloride 95 wt % and vinyl acetate 5 wt %) *to a dry film thickness of 10 microns. The transmittivity, maximum transmission density, maximum transmission density after forced deterioration and heat resistance of the coating films were compared.

*Same as in Example 12

Tests as in Example 1 were carried out as to the transmittivity and heat resistance of the coating film. The transmission density was obtained by subjecting both of the light-sensitive materials to an exposure of 250,000 lux-seconds using a tungsten light source, heating and developing at 120°C for 30 seconds and measuring the resulting blackened transmission density. The forced deterioration test was carried out by subjecting both samples to the same exposure and development mentioned above after storage in the dark for 3 days at a relative humidity of 50% and 80%. These results are tabulated below:

| | Light-sensitive Material A overcoat free | Light-sensitive Material B overcoated polymer layer |
|---|---|---|
| Transparency of coating layer, transmittivity % | 64.0 | 80.0 |
| Maximum transmission density | 2.3 | 3.0 |
| Maximum transmission density after forced deterioration | 0.5 | 1.8 |
| Heat resistance of coating layer | weak | strong |

"Weak" heat resistance means when heated for 30 seconds at 120°C, the coating layer sticks, whereas "strong" heat resistance means the coating layer does not stick.

EXAMPLE 11

6 g of benzotriazole was dissolved in 100 ml of isoamyl acetate at 50°C and cooled to −15°C. With stirring, a solution of 0.25 g of mercuric nitrate and 8.5 g of silver nitrate dissolved in 100 ml of a dilute aqueous nitric acid (pH = 2.0, 25°C), the solution being kept at 3°C, was added thereto. A dispersion containing fine crystals of silver salt of benzotriazole was thus obtained. When the dispersion was allowed to stand at room temperature for 20 seconds, an aqueous phase and an isoamyl acetate phase separated. The aqueous phase was removed and 400 ml of fresh water was added to the isoamyl acetate phase, followed by decantation. This operation was repeated three times and then 400 ml of methanol was added, followed by centrifugal separation to obtain 8 g of the silver salt of benzotriazole as grains of a substantially spherical shape of about 0.04 micron in diameter. 2.5 g of the thus obtained silver salt of benzotriazole was added to 40 ml of a solution of 4 g of polyvinyl butyral (average degree of polymerization of about 1,000) in isopropyl alcohol and ball milled for 4 hours to prepare a polymer dispersion of the silver salt. To 40 ml of the thus obtained polymer dispersion of the silver salt were added the following constituents to prepare a heat developable light-sensitive composition which was coated onto two transparent polyethylene terephthalate film support to a silver amount of 1.8 g per 1 m² of support, thus obtaining two samples of a heat developable light-sensitive material.

| | |
|---|---|
| ammonium iodide (8.5 wt % methanol solution) | 1 ml |
| methyl cellosolve solution containing 2 g of ascorbic acid-monopalmitate and 2 g of ascorbic acid-dipalmitate | 10 ml |

-continued

| | |
|---|---|
| benzoxazolilydene rhodanine sensitizing dye (0.2 wt % chloroform solution) | 1 ml |
| N-ethyl-N'-dodecyl urea (2.5 wt % methyl cellosolve solution) | 2 ml |

Light-sensitive material A thus obtained was not overcoated light-sensitive material B thus obtained was overcoated (the light-sensitive layer of light-sensitive material A) with a 15 wt % tetrahydrofuran solution of vinyl chloride-vinyl acetate copolymer (same as that of Example 10) to a dry film thickness of 8 microns. The transmittivity, maximum transmission density, maximum transmission density after forced deterioration and heat resistance of coating film were compared as in Example 10. The test methods were the same as that of Example 10.

The tests were tabulated below:

| | Light-sensitive Material A overcoat free | Light-sensitive Material B overcoated polymer layer |
|---|---|---|
| Transparency of coating layer, Transmittivity | 90% | 95% |
| Maximum transmission density | 2.0 | 2.8 |
| Maximum transmission density after forced deterioration | 1.4 | 2.7 |
| Heat resistance of coating layer | weak | strong |

EXAMPLES 12 to 16

2.7 g of silver laurate prepared by the procedure of Example 1 was added to 20 ml of an isopropyl solution containing 3.0 g of ethyl cellulose and ball milled for 1 hour to prepare a polymer dispersion of the silver salt. The resulting dispersion was coated onto transparent polyethylene terephthalate film supports in a coated silver amount of 2.0 g per 1 m² of support. The thus coated samples were referred to as "A". Five A samples were then overcoated with a 15 wt % solution of the following polymers to a dry film thickness of 2 microns. The change of transmittivity of the coating layer was measured as in Example 1 to obtain the following results:

| | Transmittivity (%) |
|---|---|
| overcoat free (Sample A) | 32.0 |
| (12) vinyl chloride-vinyl acetate copolymer (same as that of Example 10) (index of refraction 1.45; heat resistance of 150 – 170°F); | 45.5 |
| (13) polymethyl methacrylate (index of refraction 1.485-1.49; heat resistance of 140 – 190°F); | 48.0 |
| (14) polystyrene (same as in Example 1) | 53.4 |
| (15) cellulose acetate butyrate (same as in Example 2) | 49.5 |
| (16) polyvinyl chloride (same as in Example 3) | 46.0 |

EXAMPLES 17 to 21

2.7 g of silver laurate prepared by the procedure of Example 1 was added to 20 ml of a methyl ethyl ketone solution containing 3.0 g of cellulose acetate butyrate (same as in Examples 12 – 16) and ball milled for 1 hour to prepare a polymer dispersion of the silver salt. The resulting dispersion was coated onto transparent polyethylene terephthalate film supports to a coated silver amount of 2.0 g per 1 $m^2$ of support. The coated samples were referred to as "A". Five A samples were then overcoated with a 15 wt % solution of the following polymers to a dry film thickness of 2 microns. The change of transmittivity of the coating layer was measured as in Example 1 to obtain the following results:

| | Transmittivity (%) |
|---|---|
| overcoat free (Sample A) | 38.0 |
| (18) vinyl chloride-vinyl acetate copolymer (same as that of Example 12) | 44.5 |
| (19) polymethyl methacrylate (same as in Example 13) | 49.0 |
| (20) polystyrene (same as in Example 14) | 55.0 |
| (21) ethyl cellulose (index of refraction 1.48; heat resistance of 115–185°F) | 50.5 |
| (22) polyvinyl chloride (same as in Example 16) | 45.3 |

While the invention has been described in detail and with reference to specific embodiments thereof, it will be apparent to one skilled in the art that various changes and modifications can be made therein without departing from the spirit and scope thereof.

What is claimed is:

1. A heat developable light-sensitive material comprising, on a support, (1) an organic silver salt, (2) a light-sensitive silver halide or silver-halide prepared by reacting the organic silver salt with a halide, (3) a reducing agent, (4) a binder, and (5) an overcoat layer overlying components (1)–(4); said components (1)–(4) occurring in a single coated layer over said support; and said overcoat layer consisting essentially of a polymer having a refractive index greater than 1.45 at 20°C, having heat resistance to temperatures greater than about 115°F, being colorless and soluble in organic solvents, and providing increased transparency for the said overcoat layer.

2. A heat developable light-sensitive material as claimed in claim 1 wherein the organic silver salt is a salt of silver with an organic carboxylic acid or with heterocyclic compound containing an imino group.

3. A heat developable light-sensitive material as claimed in claim 2, wherein the salt is a salt of silver with an organic carboxylic acid, and the acid is long-chain aliphatic carboxylic acid having more than 10 carbon atoms.

4. A heat developable light-sensitive material as claimed in claim 2, wherein the organic silver salt is a salt of silver with a heterocyclic compound containing an imino group, which compound is benzotriazole, saccharin or phthalazinone.

5. A heat developable light-sensitive material as claimed in claim 1 wherein the silver halide is prepared by reacting the organic silver salt with an organic or inorganic halide.

6. A heat developable light-sensitive material as claimed in claim 5, wherein reaction is with an inorganic halide of the formula MXn, where X is chlorine, bromine or iodine, *n* is the valence of M, and M is hydrogen, ammonium or a metal.

7. A heat developable light-sensitive material as claimed in claim 1 wherein the amount of organic silver salt calculated as silver per square meter of support is from about 0.2 to about 3 grams.

8. A heat developable light-sensitive material as claimed in claim 7, wherein the silver halide or silver-halide prepared by reacting the organic silver salt with the halide is present in an amount of from about 0.001 mol to about 0.5 mol per mol of the organic silver salt, the reducing agent is present in an amount of from about 0.01 mol to about 5 mols per mol of the organic silver salt and the binder is present in an amount of from about 4:1 – 1:4, weight ratio.

9. A heat developable light-sensitive material as claimed in claim 8, wherein the amounts of the silver halide and reducing agent are, respectively, 0.01–0.1 mol, 0.5–1 mol, per mol of organic silver salt.

10. A heat developable light-sensitive material as claimed in claim 1 wherein said overcoat layer is from about 1 to about 20 microns thick.

11. A heat developable light-sensitive material as claimed in claim 10 wherein the overcoat layer is from 2 to 10 microns.

12. A heat developable light-sensitive material as claimed in claim 1 wherein said overcoat layer polymer is selected from the group consisting of polyvinyl chloride, polyvinyl acetate, copolymers of vinyl chloride and vinyl acetate, polyvinyl butyral, polystyrene, polymethyl methacrylate, benzyl cellulose, ethyl cellulose, cellulose acetate butyrate, cellulose acetate, polyvinylidene chloride, polyvinyl pyrrolidone, cellulose propionate, polyvinyl formal, cellulose acetate phthalate, polycarbonates, cellulose acetate propionate, gelatin, gelatin derivatives, acrylamide polymers, polyisobutylene, butadiene-styrene copolymers and polyvinyl alcohol.

13. A heat developable light-sensitive material as claimed in claim 12, wherein said overcoat polymer is selected from the group consisting of gelatin, gelatin derivatives, acrylamide polymers polyisobutylene, butadiene-styrene copolymers and polyvinyl alcohol.

14. A heat developable light-sensitive material as claimed in claim 1, wherein said binder comprises a polymer and said polymer of said overcoat layer is different from said polymer of said binder.

15. A heat developable light-sensitive material as claimed in claim 1, wherein said polymer overcoat of said layer is selected from the group consisting of polyvinyl chloride, polyvinyl acetate, copolymers of vinyl chloride and vinyl acetate, polystyrene, polymethyl methacrylate, benzyl cellulose, ethyl cellulose, cellulose acetate butyrate, cellulose acetate, polyvinylidene chloride, polyvinyl pyrrolidone, cellulose propionate, polyvinyl formal, cellulose acetate phthalate, polycarbonates, cellulose acetate propionate, gelatin, gelatin derivatives, acrylamide polymers, polyisobutylene, butadiene-styrene copolymers and polyvinyl alcohol.

16. A heat developable light-sensitive material as claimed in claim 15, wherein said binder is polyvinyl butyral.

17. A heat developable light-sensitive material as claimed in claim 1, wherein said support is transparent.

18. A heat developable light-sensitive material as claimed in claim 1, wherein said support is opaque.

19. A heat developable light-sensitive material as claimed in claim 1, wherein said overcoat layer provides improved raw storage capabilities, reduced adhesion, and increased image density for the light-sensitive material.

* * * * *